United States Patent [19]

Pensavecchia

[11] Patent Number: 4,616,853

[45] Date of Patent: Oct. 14, 1986

[54] FOOD SERVER AID

[76] Inventor: Anita Pensavecchia, P.O. Box 503, Lake Orion, Mich. 48035

[21] Appl. No.: 665,554

[22] Filed: Oct. 29, 1984

[51] Int. Cl.[4] ..... B42D 15/00; B41L 1/24

[52] U.S. Cl. ..... 283/60 A; 282/1 R

[58] Field of Search ..... 283/60 A, 60 R, 48 R, 283/61; 282/9 R, 1 R

[56] References Cited

U.S. PATENT DOCUMENTS

| | | | |
|---|---|---|---|
| 482,899 | 9/1892 | Gellenbeck | 283/60 |
| 719,209 | 1/1903 | Geller | 283/60 |
| 739,964 | 9/1903 | White et al. | 283/60 |
| 792,280 | 6/1905 | Nelson | 283/60 |
| 1,130,691 | 3/1915 | Boos | 283/60 |
| 1,296,149 | 3/1919 | Woronzoff | 283/60 |
| 1,566,019 | 12/1925 | Josephy | 283/60 |
| 2,507,307 | 5/1950 | Josephy | 282/9 R |

*Primary Examiner*—Paul A. Bell
*Assistant Examiner*—Paul M. Heyrana, Sr.

[57] ABSTRACT

A food server aid is disclosed comprised of a pad of preprinted sheets for marking of each table to be served, each sheet being printed on one side with blank spaces and notations corresponding to meal choices for each diner. The opposite side of each sheet is printed with notations corresponding to a variety of alcoholic and nonalcoholic beverages, together with notations indicating the manner of serving. The pad is sized to be carried in a server's pocket and to be easily located.

2 Claims, 2 Drawing Figures

FOOD SERVER AID

BACKGROUND OF THE INVENTION

This invention concerns food serving aids and more particularly a printed form for increasing the ease, accuracy and efficiency of the taking of food orders in restaurants.

A number of menu cards and the like have been devised in the past for minimizing fraudulent practices by serving restaurant personnel, as, for example, described in U.S. Pat. Nos. 482,899; 1,296,149; and 2,507,307.

Food serving individuals, however, particularly beginners, often have difficulty in quickly and accurately taking food orders in busy restaurants and efficiently serving such food orders after preparation of food and beverage, including cocktails. Such menu cards and the like as described have not addressed the need for assisting the food server with this task.

SUMMARY OF THE INVENTION

The present invention is embodied in an aid to the food server for accurately taking complete meal orders and beverage selections quickly and accurately and also in assisting in the efficient serving of the food and beverage orders to customers in restaurants and cocktails lounges, and the like.

The aid is comprised of a pad of preprinted sheets, each sheet carrying printed matter on each side thereof, one side being printed with an array of blank spaces together with corresponding notations for indicating the meal selections for each of a number of diners. These meal selections include the main course food item, as well as an associated array of spaces and notations indicating the manner of preparation of the food item, the selected potato, vegetable, salad dressing and soup. The opposite side of each sheet is printed with a comprehensive listing of beverage items, together with an indication of the manner of serving.

The sheets are carried in pads of approximately fifty pages and are sized approximately four by seven inches such as to be small enough to be carried in a server's pocket, but large enough to be readily located for efficient handling.

The form allows even beginning food servers to quickly, accurately and completely take food and beverage orders, and to efficiently serve the same.

DETAILED DESCRIPTION

Figure 2:
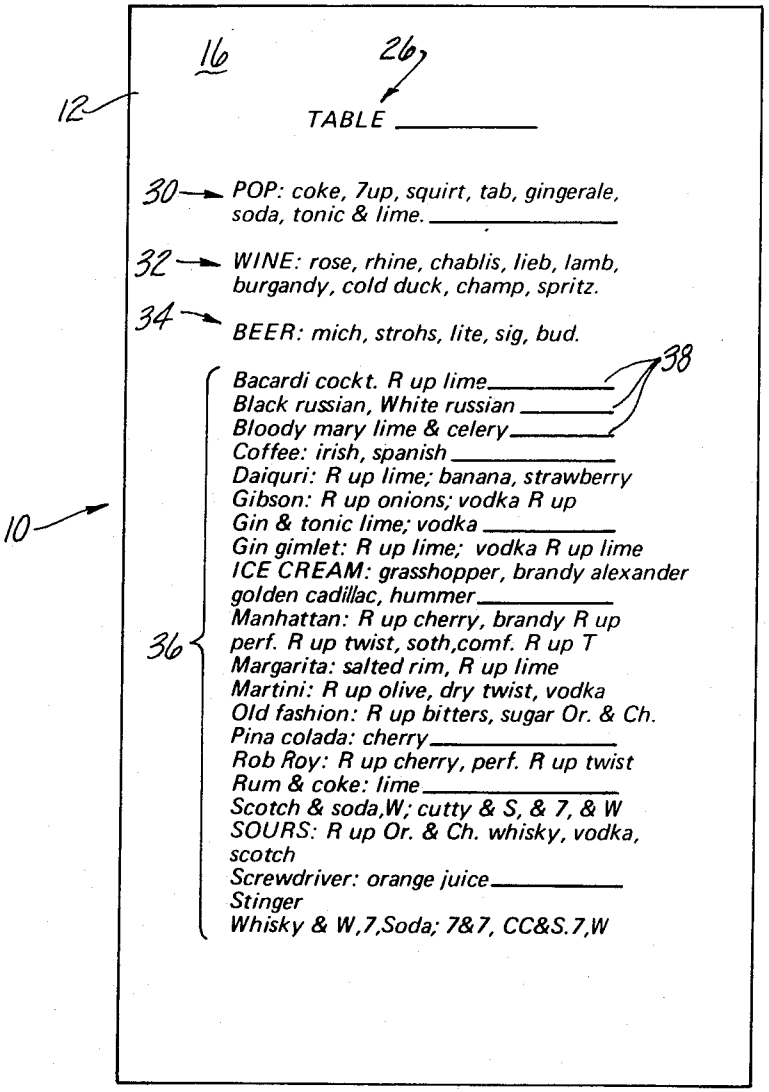
FIG. 2 is a plan view of the opposite side of a sheet of the food server aid according to the present invention.

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the food server aid according to the present invention comprises a pad indicated at 10 having a series of approximately fifty sheets assembled into a pad approximately four inches by seven inches in size. This size allows the pad to be readily stowed in a food server's pocket and yet not be lost therein, for ready retrieval in use. Each sheet 12 in the pad 10 is imprinted on either side thereof.

Figure 1:
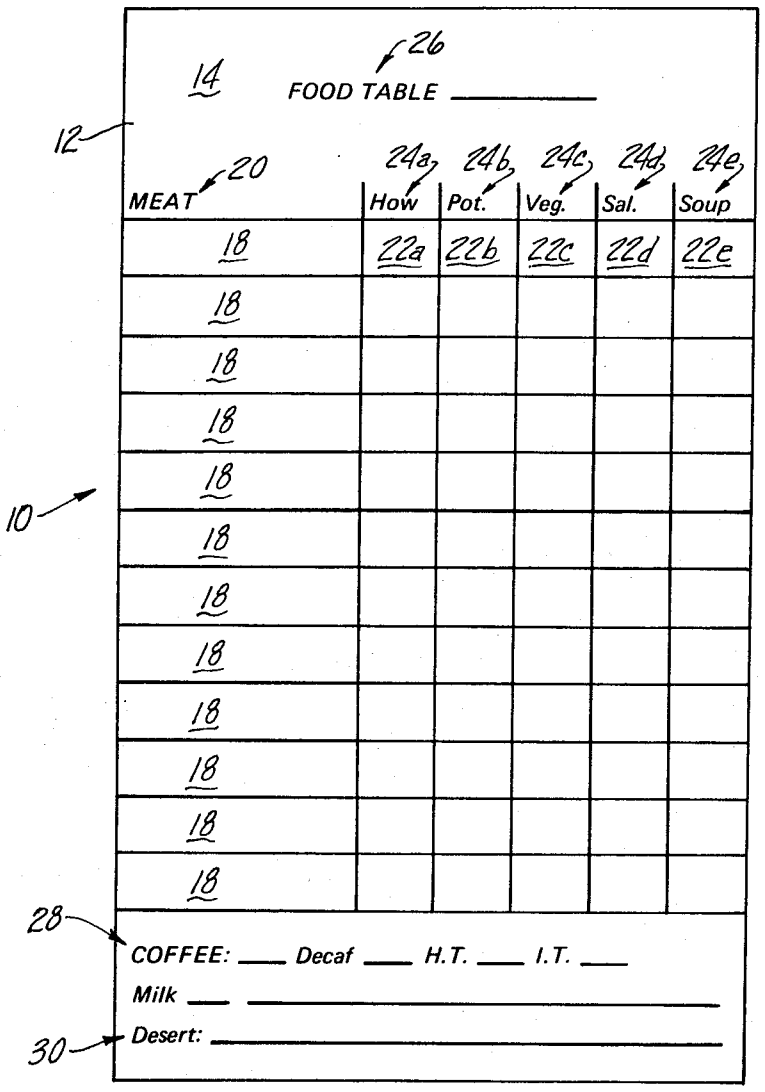
FIG. 1 is a plan view of one side of a sheet of the food server aid according to the present invention.

The upper side indicated at 14 is shown in FIG. 1 and the other side indicated at 16 is shown in FIG. 2.

Side 14 of each sheet is imprinted with a first array of vertical blank spaces 18 formed by a grid of printed lines as shown in FIG. 1. At the top of the spaces 18, the notation 20 indicates that the vertical spaces 18 are to contain identification of a main course food item, as shown in FIG. 1. An array of additional blank spaces 22 also formed by a grid of printed lines extend opposite each blank space 18. Each of the spaces 22A–22E are vertically aligned as shown, and notation 22A indicates the manner of preparation of the food item, i.e., medium, well done, etc., in the case of the main course, 22B indicates the type of potato a given diner is to be served, 22C indicates the type of vegetable, 22D indicates the type of salad dressing, and 22E indicates the type of soup.

A number of vertical spaces 18 and 22 correspond to allow accommodation of the largest of parties normally served in the process of the food server taking the order at a given table. One side 14 of each sheet 12 is also provided with a designation notation identifying the table number to be associated with a given food order, as indicated in FIG. 1.

In the lower region of side 14, the notation 28 indicates the beverages normally served with meals, as well as the desert notation 30.

The opposite side 16 of each sheet 12 is also printed with a table identification space and notation 26. The imprinting carried on the other side 16 consists of a substantially comprehensive listing of dinner beverage items, including, by category, soft drinks 30, wine 32, beer 34, and cocktail items 36. In the case of cocktail items 36, spaces are provided defined by printing lines 38 for indicating the manner of serving, i.e., up, on-the-rocks, or special instructions as to serving.

Thus, the food server in taking the orders is reminded by the notations of the questions to be asked of each diner at a table and an organized identification or indication of each diner's order, both food and drink, is provided. Thus, even beginning food servers can quickly, efficiently and accurately obtain the food order and serve these orders to the respective diners.

The pad lends itself to efficient use, being sized to be quickly retrieved from the server's pocket and marked in the taking of each table's food and beverage order. Thereafter, the individual sheets can be torn off and disposed of.

The sheets can be easily and economically produced at very low cost such that they can be adaptable to food servers employed in a wide variety of establishments, not limited to any particular place or type of food serving business.

Many variations in the format of course are possible in the specifics of the notation and arrangement of the printed matter on the individual sheets.

I claim:

1. A food server aid comprising:

a pad of sheets, each sheet printed on both sides and being roughly four inches wide and seven inches high;

one side of each sheet printed with an array of blank spaces and associated notations comprising a vertical series of blank spaces formed by a grid of printed lines arranged beneath a notation designating the spaces as a location to mark main course food items, a plurality of rows corresponding to blank spaces formed by a grid of printed lines aligned horizontally with a respective one of said first-mentioned main course blank spaces, each of said blank spaces in said rows vertically aligned beneath notations indicating respectively the degree of cooking of the main course food item, the type of potato, vegetable, salad dressing and soup;

the other side of each of said sheets printed with notation indicating a listing of alcoholic and other beverages and the manner of serving of at least some of such listings of beverage;

both sides of said sheets printed with a notation and space for indicating the table identification.

2. The food server aid according to claim 1 wherein said one side of each sheet is also printed with notations indicating beverages typically served with a meal, beneath said blank space array.

* * * * *